US006995327B1

(12) United States Patent
Shepstone et al.

(10) Patent No.: US 6,995,327 B1
(45) Date of Patent: Feb. 7, 2006

(54) FOUR-WAY INTERLOCK SYSTEM AND BYPASS TRANSFER SWITCH EMPLOYING THE SAME

(75) Inventors: Gordon A. Shepstone, Burlington (CA); Robert N. Conway, Guelph (CA); Mihali Milev, Mississauga (CA); Andy Feng Li, Hamilton (CA)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/103,242

(22) Filed: Apr. 11, 2005

(51) Int. Cl.
*H01H 1/20* (2006.01)
*H01H 9/20* (2006.01)

(52) U.S. Cl. ..... 200/50.32; 200/50.01; 361/609

(58) Field of Classification Search .... 200/50.01–50.2, 200/50.28, 50.3, 50.32, 50.33; 361/62, 605–609, 361/615
See application file for complete search history.

(56) References Cited

U.S. PATENT DOCUMENTS 4,295,053 A * 10/1981 Kovatch et al. ..... 307/64
4,398,097 A 8/1983 Schell et al.
4,747,061 A 5/1988 Lagree et al.
4,760,278 A 7/1988 Thomson
4,894,796 A 1/1990 Engel et al.
5,081,367 A 1/1992 Smith et al.
5,200,586 A * 4/1993 Smith et al. ..... 200/50.32
5,210,685 A 5/1993 Rosa
5,397,868 A 3/1995 Smith et al.
5,550,707 A * 8/1996 Iversen ..... 361/617
5,646,459 A * 7/1997 Hatate et al. ..... 307/85
6,005,206 A * 12/1999 Rakus et al. ..... 200/244
6,388,214 B1 5/2002 Jones et al.
6,590,756 B2 7/2003 Meiners et al.

* cited by examiner

*Primary Examiner*—Kyung Lee
(74) *Attorney, Agent, or Firm*—Martin J. Moran

(57) ABSTRACT

An interlock system is for a bypass transfer switch including first, second, third and fourth circuit breakers. First, second, third and fourth interlock assemblies each include a mounting bracket coupled on or proximate to a corresponding one of the circuit breakers, a transmitting member disposed on the mounting bracket and coupled to the poleshaft of the operating mechanism of the corresponding one of the circuit breakers, and a receiving mechanism disposed on the mounting bracket and structured to engage and actuate the circuit breaker trip lever in response to a trip condition. The transmitting member and receiving mechanism each include primary and secondary connections. A plurality of linkages are adapted to interconnect the connections among the circuit breakers in order to provide a predetermined automatic bypass interlock mechanism, without requiring a separate manual locking device.

20 Claims, 5 Drawing Sheets

2

FOUR-WAY INTERLOCK SYSTEM AND BYPASS TRANSFER SWITCH EMPLOYING THE SAME

BACKGROUND OF THE INVENTION

1. Field of the Invention

The present invention relates generally to electrical switching apparatus and, more particularly, to a bypass transfer switch including an interlock system. The invention also relates to an interlock system for a bypass transfer switch.

2. Background Information

Alternate power sources are provided for any number of applications which cannot withstand a lengthy interruption in electric power. Typically, electric power is provided from a primary source with back-up power provided by a secondary source. Often, the primary source is a utility power source and the secondary source is an auxiliary power source, such as an engine driven generator or a second utility source. The transfers between the two power sources can be made automatically or manually.

Transfer switches are well known in the art. See, for example, U.S. Pat. Nos. 5,397,868; 5,210,685; 4,894,796; and 4,747,061. Transfer switches operate, for example, to transfer a power consuming load from a circuit with a normal power supply to a circuit with an auxiliary power supply. Applications for transfer switches include stand-by applications, among others, in which the auxiliary power supply stands-by if the normal power supply should fail. Facilities having a critical requirement for continuous electric power, such as hospitals, certain plant processes, computer installations, and the like, have a standby power source, often a diesel generator. A transfer switch controls electrical connection of the utility lines and the diesel generator to the facility load buses. In many installations, the transfer switch automatically starts the standby generator and connects it to the load bus upon loss of utility power, and reconnects the utility power to the load bus if utility power is reestablished.

In the case of a generator driven auxiliary power source, power must be stabilized before the transfer can be made to the secondary source. In any event, the two power sources cannot be connected to the load simultaneously unless they suitably match their respective voltages, frequencies and phases. Some transfer switches affect an open transition between the power sources, that is, one is disconnected from the load bus before the other one is connected. Other transfer switches provide a closed transition wherein the one source is connected to the load bus before the other source is disconnected, in order that both power sources are connected in parallel during the transition.

Transfer switches commonly used to connect alternate power sources to a load, including networks, utilize a pair of switches each connecting one of the sources to the load. In order to prevent connecting unsynchronized sources together, the operation of the two switches is coordinated, typically by a mechanical interlock, in order that only one switch at a time can be turned on. Each transfer switch generally comprises a pair of circuit interrupters combined with a drive input and a linkage system. The preferred types of circuit interrupters have been molded-case switches and molded-case circuit breakers because these types are commercially available in a wide array of sizes and are relatively economical compared to other options. The circuit breaker enclosure or cassette of some of these circuit interrupters have a dual lever interlock feature. The preferred type of drive input depends on the application for the transfer switch. Motors are often preferred, but at other times there is a clear preference for manually-operated mechanisms.

One type of breaker bypass system is a four-way or four-breaker bypass system which typically comprises two adjacent normal line breakers positioned on top of two adjacent emergency line breakers. Such a system must comply with the logic scheme wherein if one breaker is on while two selected breakers are held off, the last breaker may be either on or off. Known four-way bypass transfer switches have accomplished this logic scheme through use of two-way cable interlocks between normal and emergency breakers for the transfer switch and bypass sections. However, this approach requires additional interlocking when performing bypassing operations, in order to ensure that unsynchronized paralleling of normal and emergency sources does not occur. Specifically, a plurality of commercially available locking assemblies such as, for example, KIRK® keys, are required between the normal breaker automatic transfer switch (ATS) and the emergency breaker (bypass) as well as between the emergency breaker (ATS) and the normal breaker (bypass). A KIRK® key is a well known keyed locking device. Utilizing KIRK® keys enables the four-way breaker interlocking scheme to be achieved, but it adds complexity and time to the bypass operation. In critical power applications, such as those previously discussed (e.g., without limitation, hospitals) where bypassing must occur very rapidly in order to resist an interruption in power, the added time and complexity of the KIRK® key bypass interlock scheme is unacceptable.

There is a need, therefore, for a simplified four-way bypass interlock system.

There is, therefore, room for improvement in bypass transfer switches and in interlock systems therefor.

SUMMARY OF THE INVENTION

These needs and others are satisfied by the present invention, which is directed to an interlock system for bypass transfer switch applications.

As one aspect of the invention, an interlock system is for a bypass transfer switch including a plurality of circuit breakers each having separable contacts and, an operating mechanism for opening and closing the separable contacts. The operating mechanism includes a poleshaft operable between first and second positions corresponding to the separable contacts being closed and opened, respectively, and a trip lever adapted to open the separable contacts when actuated. The interlock system comprises a plurality of interlock assemblies each structured to be coupled to a corresponding one of the circuit breakers, each of the interlock assemblies comprising: a mounting bracket structured to be coupled on or proximate to the corresponding one of the circuit breakers, a transmitting member disposed on the mounting bracket and structured to be coupled to the poleshaft of the operating mechanism of the corresponding one of the circuit breakers in order to move therewith, and a receiving mechanism disposed on the mounting bracket and structured to engage and actuate the trip lever of the operating mechanism of the corresponding one of the circuit breakers in response to a trip condition, the transmitting member and the receiving mechanism each including a primary connection and a secondary connection; and a plurality of linkages structured to interconnect at least the primary connections of a first interlock assembly of the interlock assemblies with the primary connections of a second interlock assembly of the interlock assemblies and the secondary connections of the first interlock assembly with the secondary connections of a third interlock assembly of the interlock assemblies. The first and second interlock assemblies are structured to be coupled, respectively, to first and second corresponding circuit breakers, and the third interlock assembly is structured to be coupled to a third corresponding circuit breaker. The linkages are adapted to provide a predetermined automatic bypass interlock mechanism, without requiring a separate manual locking device.

The interlock system may be a four-way interlock system wherein the bypass transfer switch includes first, second, third and fourth corresponding circuit breakers and the interlock assemblies include the first, second and third interlock assemblies which are structured to be coupled, respectively, to the first, second and third corresponding circuit breakers and, a fourth interlock assembly structured to be coupled to the fourth corresponding circuit breaker. The linkages may include first, second, third and fourth pairs of push, pull cables wherein the first pair of push, pull cables interconnects the primary connections of the first interlock assembly of the first corresponding circuit breaker with the primary connections of the second interlock assembly of the second corresponding circuit breaker, wherein the second pair of push, pull cables interconnects the secondary connections of the first interlock assembly with the secondary connections of the third interlock assembly of the third corresponding circuit breaker, wherein the third pair of push, pull cables interconnects the primary connections of the third interlock assembly with the primary connections of the fourth interlock assembly of the fourth corresponding circuit breaker, and wherein the fourth pair of push, pull cables interconnects the secondary connections of the fourth interlock assembly with the secondary connections of the second interlock assembly.

Each of the first, second, third and fourth corresponding circuit breakers may have an ON state and an OFF state and, may include a partner circuit breaker among the other circuit breakers of the first, second, third and fourth corresponding circuit breakers, wherein when one of the first, second, third and fourth corresponding circuit breakers is ON, the partner circuit breaker may be either ON or OFF and the predetermined automatic bypass interlock mechanism is structured to automatically hold the remaining circuit breakers OFF.

As another aspect of the invention, a bypass transfer switch comprises: a plurality of circuit breakers each having a pair of separable contacts and, an operating mechanism for opening and closing the separable contacts, the operating mechanism including a poleshaft operable between first and second positions corresponding to the separable contacts being closed and opened, respectively, and a trip lever adapted to open the separable contacts when actuated; and an interlock system adapted to provide a predetermined automatic bypass interlock mechanism for the circuit breakers, the interlock system comprising: a plurality of interlock assemblies each coupled to a corresponding one of the circuit breakers and including a mounting bracket coupled on or proximate to the corresponding one of the circuit breakers, a transmitting member disposed on the mounting bracket and coupled to the poleshaft of the operating mechanism of the corresponding one of the circuit breakers in order to move therewith, and a receiving mechanism disposed on the mounting bracket and structured to engage and actuate the trip lever of the operating mechanism of the corresponding one of the circuit breakers in response to a trip condition, the transmitting member and the receiving mechanism each including a primary connection and a secondary connection, and a plurality of linkages structured to interconnect at least the primary connections of a first interlock assembly of the interlock assemblies with the primary connections of a second interlock assembly of the interlock assemblies and the secondary connections of the first interlock assembly with the secondary connections of a third interlock assembly of the interlock assemblies. The first and second interlock assemblies are coupled, respectively, to first and second corresponding circuit breakers, and the third interlock assembly is coupled to a third corresponding circuit breaker, and the linkages are adapted to provide the predetermined automatic bypass interlock mechanism, without requiring a separate manual locking device.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
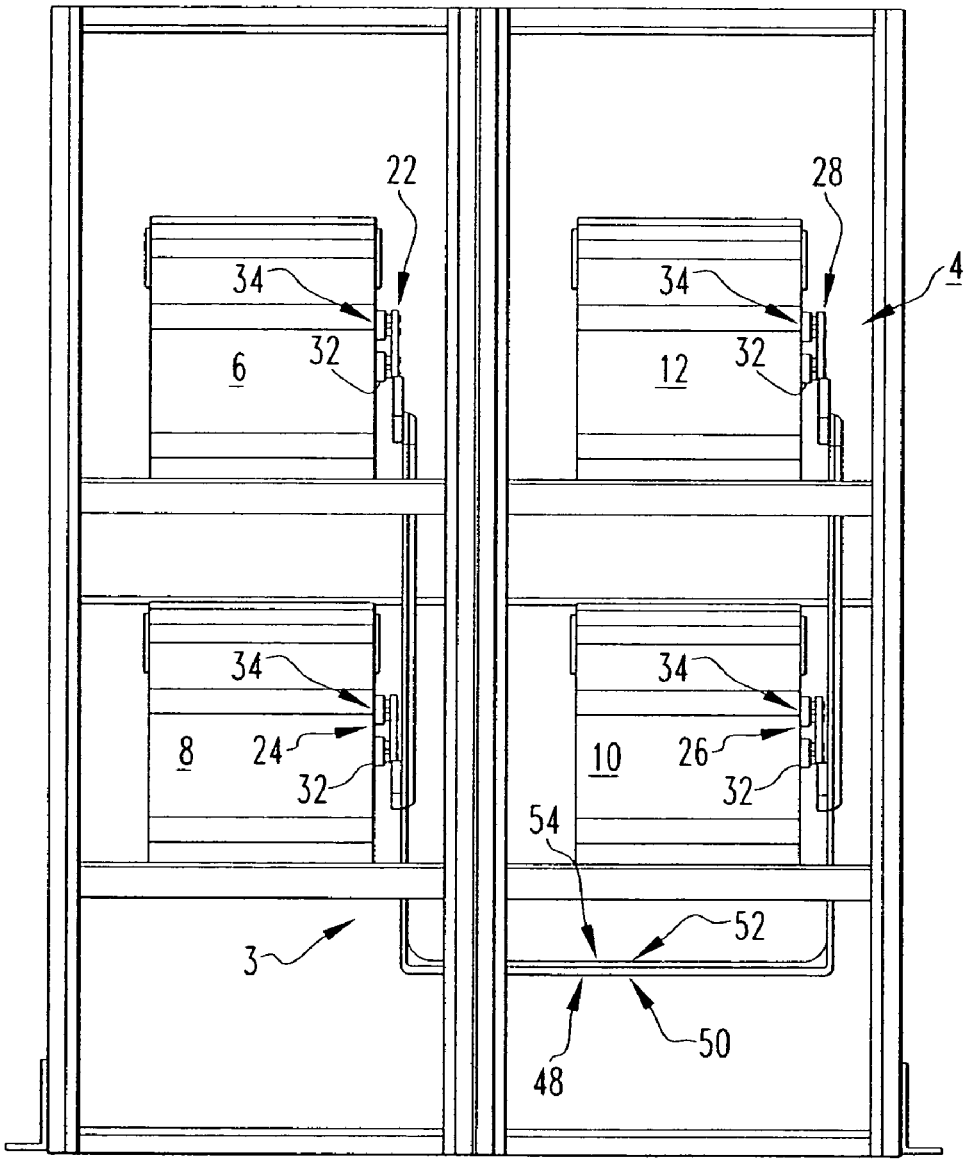
FIG. 1 is a front elevational view of a four-breaker bypass transfer switch in accordance with the invention, showing two normal circuit breakers disposed on top of and interconnected with two emergency circuit breakers.

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "linkage" refers to any known or suitable mechanism (e.g., without limitation, a cable; a wire; a chain; a number of interconnected links; a rigid member) for interconnecting one component to another in order to provide mechanical communication therebetween.

FIG. 1 shows a bypass transfer switch 2 employing an interlock system 4 in accordance with the present invention. The bypass transfer switch 2 generally includes a plurality of circuit breakers 6,8,10,12 and the interlock system 4 which is adapted to provide a predetermined automatic bypass interlock mechanism 3 for the circuit breakers 6,8,10,12, without requiring a separate manual locking device (e.g., without limitation, KIRK® key).

Figure 2:
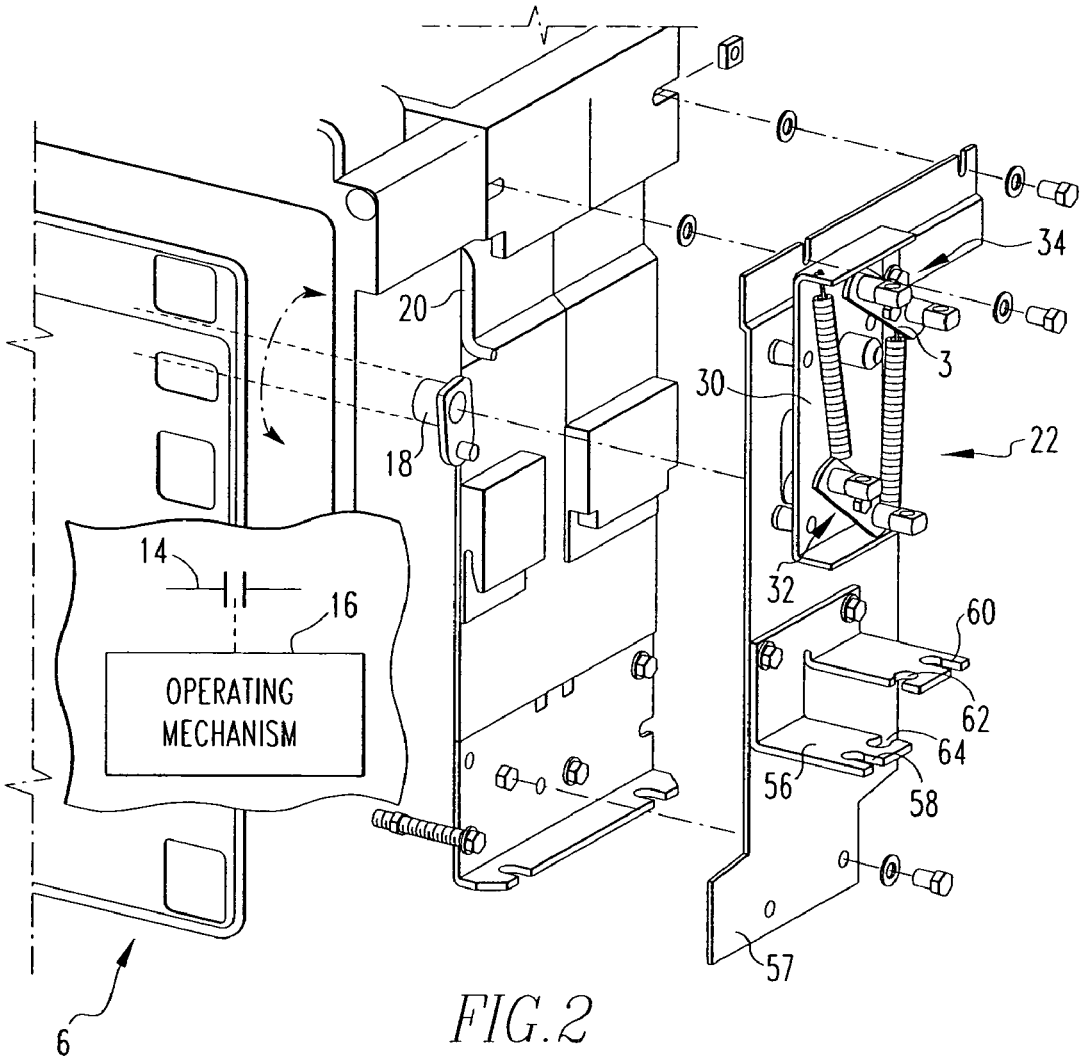
FIG. 2 is an exploded, isometric view of a portion of one of the circuit breakers of FIG. 1, showing the circuit breaker poleshaft in hidden line drawing and, an interlock assembly for the circuit breaker with a portion of the circuit breaker cut-away to show internal structures.

FIG. 2 illustrates certain structures of one of the circuit breakers (e.g., circuit breaker 6) including a pair of separable contacts 14 and an operating mechanism 16 for opening and closing the separable contacts 14. The operating mechanism 16, which is schematically shown in FIG. 2, includes a poleshaft 18 (shown in hidden line drawing), which is operable between first and second positions corresponding to a separable contacts 14 (also shown schematically) being closed and opened, respectively. The operating mechanism 16 further includes a trip lever 20 adapted to open the separable contacts 14 when actuated. The above components of FIG. 2 are conventional.

Figure 4:
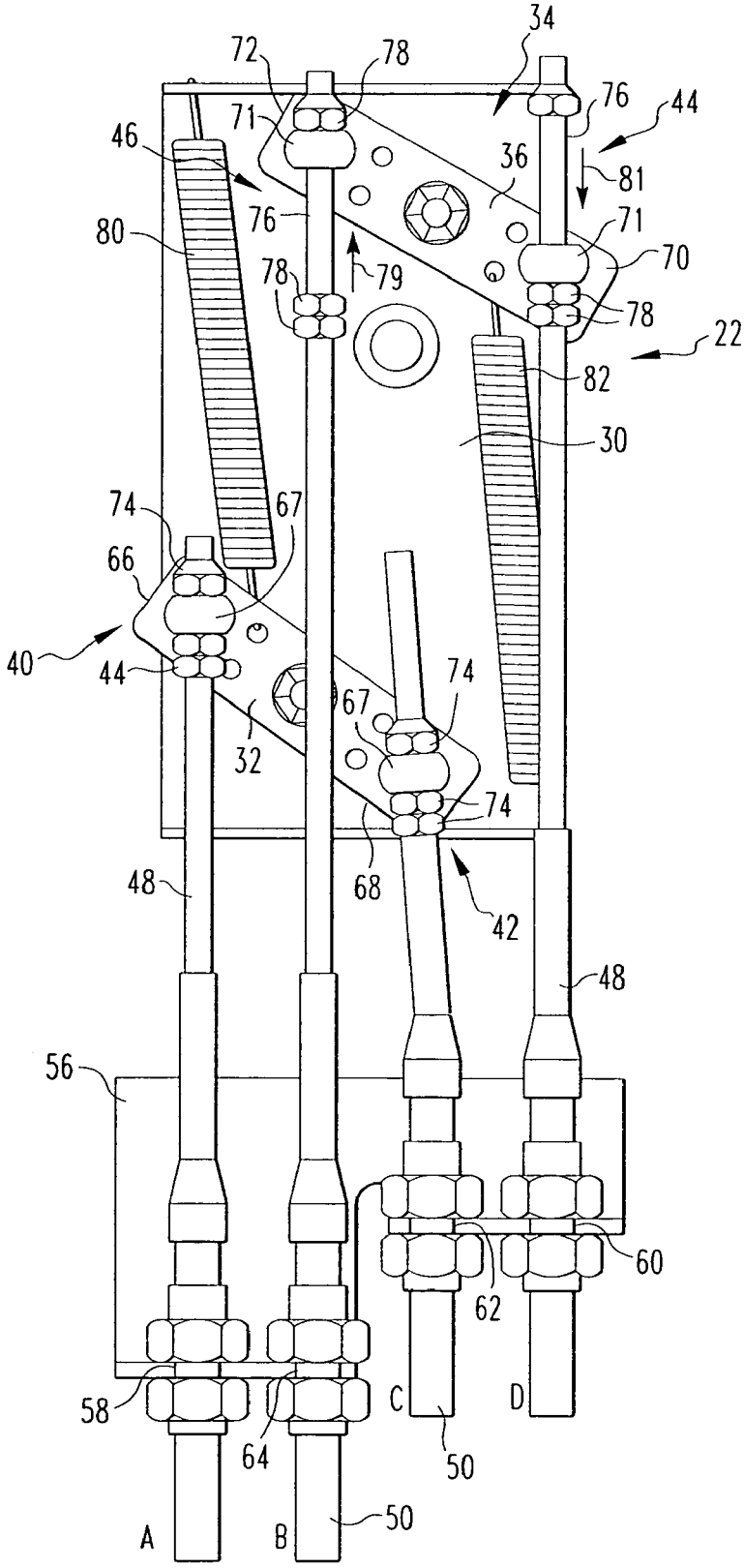
FIG. 4 is a vertical elevational view of one of the interlock assemblies of FIG. 3.

Also, referring to FIG. 4, the interlock system 4 includes a plurality of interlock assemblies 22,24,26,28 each structured to be coupled to a corresponding one of the circuit breakers 6,8,10,12. Each of the interlock assemblies 22,24, 26,28 comprises a mounting bracket 30 structured to be coupled on or approximate to the corresponding one of the circuit breakers 6,8,10,12, a transmitting member 32 disposed on the mounting bracket 30 and structured to be coupled to the poleshaft 18 of the operating mechanism 16 in order to move therewith and, a receiving mechanism 34 disposed on the mounting bracket 30 and structured to engage and actuate the trip lever 20 of the operating mechanism 16 in response to a trip condition. As employed herein, the term "trip condition" refers to any abnormal or electrical condition causing the circuit breaker, for example, to trip and expressly includes, without limitation, an overcurrent condition, an overload condition, an arc fault condition, a ground fault condition, an undervoltage condition, or a relatively high level short circuit or fault condition.

Figure 3:
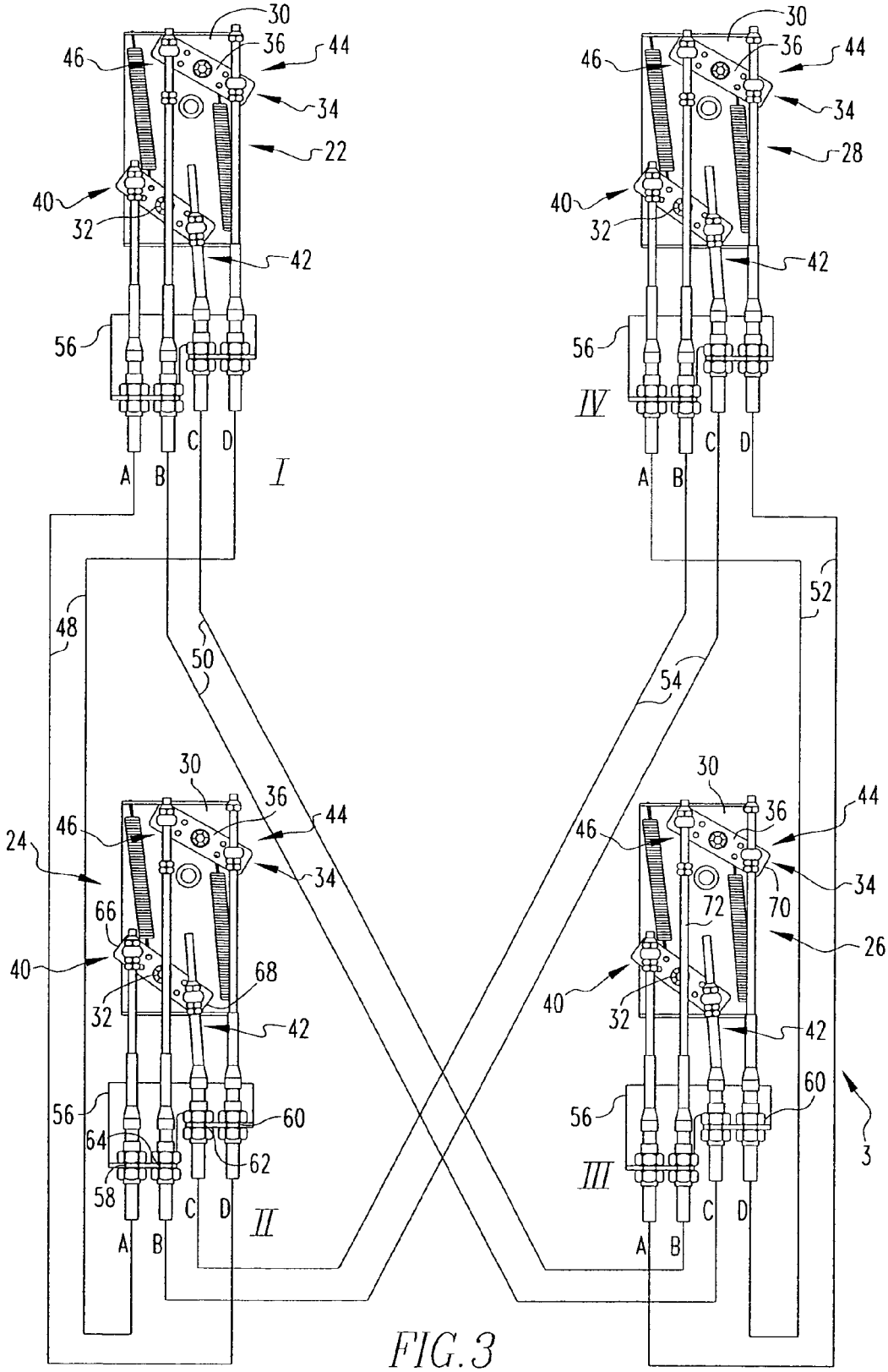
FIG. 3 is a vertical elevational view of the interlock assemblies for all four circuit breakers of the four-breaker bypass transfer switch of FIG. 1, showing, schematically, the cable routing among the circuit breakers.

The transmitting member 32 and the receiving mechanism 34 each include a primary connection 40;44 and a secondary connection 42;46 (best shown in FIG. 3).

As shown in the example of FIG. 3, a plurality of linkages 48,50,52,54 (represented schematically) are structured to interconnect at least the primary connections 40;44 of the first interlock assembly 22 with the primary connections 40;44 of the second interlock assembly 24 and the secondary connections 42;46 of the first interlock assembly 22 with the secondary connections 42;46 of the third interlock assembly 26. Accordingly, the first and second interlock assemblies 22,24 are structured to be coupled, respectively, to first and second corresponding circuit breakers 6,8, and the third interlock assembly 26 is structured to be coupled to the third corresponding circuit breaker 10. In accordance with the foregoing arrangement, the linkages 48,50,52,54 are adapted to provide the predetermined automatic bypass interlock mechanism 3, automatically, without requiring any separate manual locking device, such as the KIRK® key, previously discussed.

The exemplary interlock system 4 shown and discussed herein, is a four-way interlock system wherein the bypass transfer switch 2 includes the aforementioned first, second and third corresponding circuit breakers 6,8,10 as well as the fourth corresponding circuit breaker 12, and the interlock assemblies include the aforementioned first, second and third interlock assemblies 22,24,26 which are coupled, respectively, to the first, second and third corresponding circuit breakers 6,8,10 and, the fourth interlock assembly 28 structured to be coupled to the fourth corresponding circuit breaker 12.

Each of the linkages 48,50,52,54 in this example, is a pair of push, pull cables, although a wide range of suitable linkages may be employed. Thus, as shown in FIG. 3, the first pair of exemplary push, pull cables 48 interconnects the primary connections 40;44 of the first interlock assembly 22 of circuit breaker 6 with the primary connections 40;44 of the second interlock assembly 24 of second corresponding circuit breaker 8. The second pair of push, pull cables 50 interconnects the secondary connections 42;46 of the first interlock assembly 22 with the secondary connections 42;46 of the third interlock assembly 26 of third corresponding circuit breaker 10. The third pair of push, pull cables 52 interconnects the primary connections 40;44 of the third interlock assembly 26 with the primary connections 40;44 of the fourth interlock assembly 28 of fourth corresponding circuit breaker 12 and, the fourth pair of push, pull cables 54 interconnects the secondary connections 42;46 of the fourth interlock assembly 28 with the secondary connections 42;46 of the second interlock assembly 24. The foregoing cable routing may be further understood with reference to Table 1:

TABLE 1

| From Connection | To Connection |
|---|---|
| IC | IIIB |
| IIIC | IB |
| IVC | IIB |
| IIC | IVB |
| IA | IID |
| IIA | ID |

wherein I,II,III and IV represent, respectively, the first, second, third and fourth circuit breakers 6,8,10,12, as labeled in the example of FIG. 3; wherein A and D represent the primary connections 40;44 of the circuit breakers 6,8, 10,12, as shown in FIG. 3; and wherein B and C represent the secondary connections 42;46 of the circuit breakers 6,8,10,12.

Each of the circuit breakers 6,8,10,12 of the exemplary interlock system 4 has an ON state corresponding to the poleshaft 18 (FIG. 2) of a circuit breaker being disposed in the first position in which the separable contacts 14 (FIG. 2) are closed, and an OFF state corresponding to the poleshaft 18 being disposed in the second position in which the separable contacts 14 are open. Each of the circuit breakers 6,8,10,12 also includes a partner circuit breaker among the other circuit breakers 6,8,10,12. For instance, in the example of FIG. 3, the first and the fourth corresponding circuit breakers 6,12 are normal circuit breakers, the first normal circuit breaker 6 being a partner of normal circuit breaker 12 and being disposed on top of (from the perspective of FIG. 1) the second and third corresponding circuit breakers 8,10 which are emergency breakers. Similarly, emergency circuit breaker 8 is a partner of emergency circuit breaker 10 and vise-versa.

Accordingly, the foregoing cable routing enables the exemplary predetermined automatic bypass interlock mechanism 3 to automatically provide a bypass interlock logic in which when one of the first, second, third and fourth corresponding circuit breakers 6,8,10,12 is ON, its partner circuit breaker may be either ON or OFF and the remaining two circuit breakers are held OFF. By way of example, with reference to FIG. 3, if normal circuit breaker 6 (labeled as circuit breaker I in FIG. 3) is turned ON, partner normal circuit breaker 12 (labeled as circuit breaker IV in FIG. 3) can be either ON or OFF but, the predetermined automatic bypass interlock mechanism 3 automatically holds the remaining circuit breakers 8 (labeled circuit breaker 11 in FIG. 3) and 10 (labeled circuit breaker 111 in FIG. 3) OFF. The foregoing bypass interlock mechanism 3 of the invention may be further understood with reference to the logic of Table 2:

TABLE 2

| Breaker | I | II | III | IV |
|---|---|---|---|---|
| I | ON | OFF | OFF | ON/OFF |
| II | OFF | ON | ON/OFF | OFF |
| III | OFF | ON/OFF | ON | OFF |
| IV | ON/OFF | OFF | OFF | ON |

wherein I,II,III and IV represent, respectively, the first, second, third and fourth circuit breakers 6,8,10,12.

FIGS. 4 and 5A–5C and 6A–6C further illustrate one interlock assembly 22 of the exemplary interlock assembly 4 (FIG. 3).

As shown in FIG. 4, each interlock assembly (e.g., interlock assembly 22) includes a cable bracket 56 having four receptacles 58,60,62,64 structured to receive and secure two pairs 48,50 of the first, second, third and fourth pairs of push, pull cables 48,50,52,54 (FIG. 3). The cable bracket 56 is structured to couple the two pairs of push, pull cables 48,50 for the corresponding circuit breaker 6 (FIG. 1) proximate the mounting bracket 30 of the interlock assembly 22. More specifically, as shown in the example of FIG. 2, the cable bracket 56 is mounted on a mounting bracket 57 beneath the bracket 30 of interlock assembly 22. The mounting plate 57 is then coupled to a side of the circuit breaker 6 which, in the example of FIG. 2, is a molded case circuit breaker. However, it will be appreciated that the cable bracket 56 and the mounting bracket 30 could alternatively be mounted directly to a side (not shown) of the circuit breaker 6 or to an enclosure (not shown) or cassette (not shown) for the circuit breaker such as, in the example of a draw-out type circuit breaker (not shown).

Figure 5A:
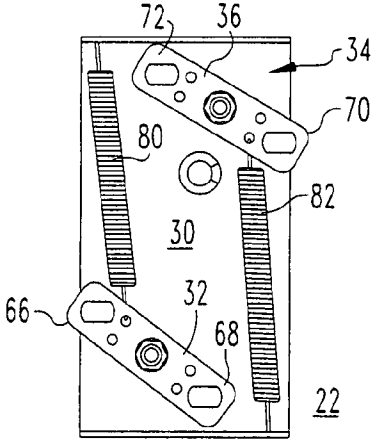
FIGS. 5A, 5B and 5C are vertical elevational views of a first side of the interlock assembly of FIG. 4 modified, respectively, to show the interlock assembly as positioned when the associated circuit breaker is open, closed and tripped open.
Figure 5B:
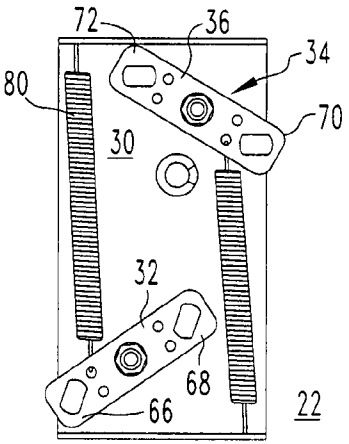
Figure 5C:
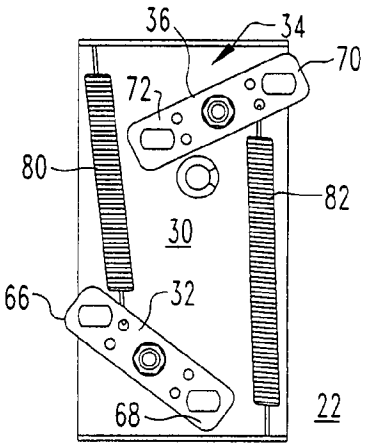
Figure 6A:
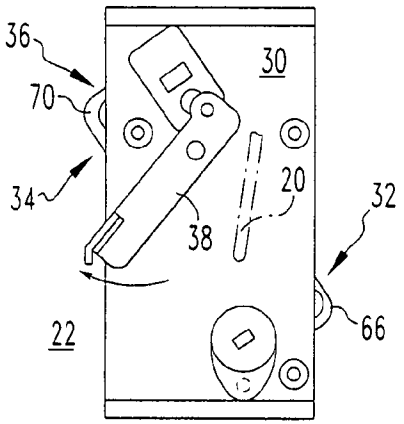
FIGS. 6A, 6B and 6C are vertical elevational views of the back side of the interlock assemblies of FIGS. 5A, 5B and 5C and corresponding, respectively, thereto.
Figure 6B:
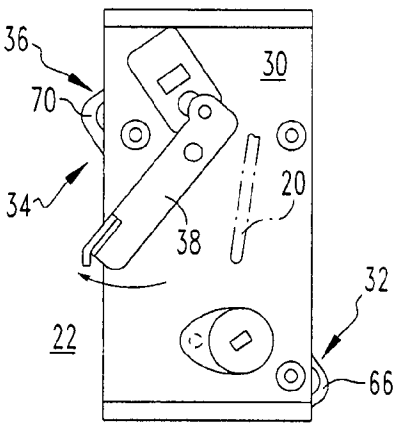
Figure 6C:
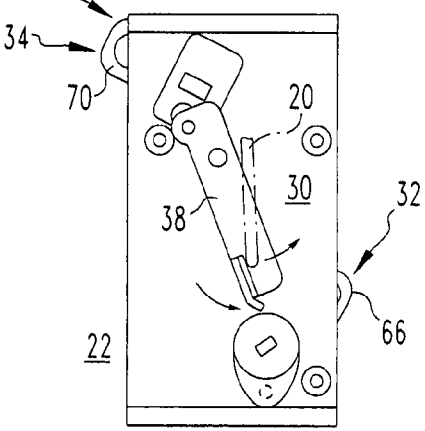

As shown in FIGS. 5A–5C, which show the outside (e.g., from the perspective of FIG. 2) of the interlock assembly 22, and FIGS. 6A–6C, which correspondingly show the inside (e.g., from the perspective of FIG. 2) of the interlock assembly 22, the receiving mechanism 34 includes a receiving member 36 and a paddle member 38 (FIGS. 6A–6C) coupled to the receiving member 36. The paddle member 38 is structured to move with the receiving member 36 in order to engage and actuate the trip lever 20 (FIG. 6C) in response to the trip condition. The transmitting member 32 and the receiving member 36 of each interlock assembly (e.g., 22) includes a first end 66;70 and a second end 68;72, as shown. Referring back to FIG. 4, it will be understood that the primary connections 40;44 are coupled to the first ends 66;70 of the transmitting member 32 and the receiving member 36, and the secondary connections 42;46 are coupled to the second ends 68;72 of the transmitting member 32 and the receiving member 36, respectively.

Continuing to refer to FIG. 4, it will be appreciated that the exemplary primary and secondary connections 40,42 of the transmitting member 32, are fixed connections each including one push, pull cable (e.g., cable A of first pair of push, pull cables 48 and cable C of second pair of push, pull cables 50) secured adjacent the first and second ends 66,68 of the transmitting member 32 by a first plurality of fasteners 74. The exemplary fasteners 74 are a pair of nuts on the bottom side (with respect to FIG. 4) and a single nut on the top side (with respect to FIG. 4) of the exemplary swivel connectors 67 on the first and second ends 66,68 of the transmitting member 32. However, any known or suitable securing mechanism could be alternatively employed. In this manner, the push, pull cables A, C move with the transmitting member 32 and do not move independently with respect thereto.

Conversely, the exemplary primary and secondary connections 44;46 of the receiving member 36 are push, pull connections which each include one push, pull cable (e.g., cable B of second pair of push, pull cables 50 and cable D of first pair of push, pull cables 48) being moveably coupled to the first and second ends 70,72 of the receiving member 36 by a slider 76 and a second plurality of fasteners 78. The second plurality of fasteners 78, like the first plurality of fasteners 74 includes a double nut 78 arrangement below (with respect to FIG. 4) the exemplary swivel connectors 71 at the first and second ends 70,72 of the receiving member 36, and a single nut 78 above (with respect to FIG. 4) the swivel connectors 71. The slider 76 is disposed between the double nuts 78 below the swivel connector 71 and the single nut 78 above the swivel connector 71 and, is structured to provide movement of the push, pull cables B, D independently with respect to the receiving member 36 in one of a push direction, indicated by arrow 79 of FIG. 4, and a pull direction, indicated by arrow 81 of FIG. 4. The fasteners 78 (e.g., nuts) are structured to engage the exemplary swivel connector 71 of the receiving member 36 in order that the push, pull cables B, D and the receiving member 36 move together in order to provide positive movement of the receiving member 36 in the other of the push direction (e.g., arrow 79 of FIG. 4) and the pull direction (e.g., arrow 81 of FIG. 4). It will, however, be appreciated that any known or suitable alternative sliding configuration could be employed in order to permit movement of the cables (e.g., cables B and D) in relation to the receiving member 36 in one direction, but not in the other direction.

As best shown in FIGS. 5A–5C, the interlock assemblies (e.g., interlock assembly 22) further include first and second springs 80,82. The first spring 80 is disposed between the first end 66 of the transmitting member 32 in the mounting bracket 30, as shown, in order to bias the transmitting member 32 in the poleshaft 18 to which it is coupled, toward the second position in which the separable contacts 14 (FIG. 2) are open. The second spring 82 is disposed between the first end 70 of the receiving member 36 in the mounting bracket 30 in order to bias the receiving member 36 away from actuating the trip lever 20 (FIG. 2).

Accordingly, the invention achieves a bypass interlocking scheme that incorporates all necessary modes of operation automatically, without the requirement of using, for example, KIRK® keys. Elimination of the conventional KIRK® key requirement simplifies overall operation of the bypass transfer switch assembly and dramatically decreases the time required to perform bypassing functions.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An interlock system for a bypass transfer switch including a plurality of circuit breakers each having separable contacts and, an operating mechanism for opening and closing said separable contacts, said operating mechanism including a poleshaft operable between first and second positions corresponding to said separable contacts being closed and opened, respectively, and a trip lever adapted to open said separable contacts when actuated, said interlock system comprising:

a plurality of interlock assemblies each structured to be coupled to a corresponding one of said circuit breakers, each of said interlock assemblies comprising:

a mounting bracket structured to be coupled on or proximate to said corresponding one of said circuit breakers, a transmitting member disposed on said mounting bracket and structured to be coupled to said poleshaft of said operating mechanism of said corresponding one of said circuit breakers in order to move therewith, and a receiving mechanism disposed on said mounting bracket and structured to engage and actuate said trip lever of said operating mechanism of said corresponding one of said circuit breakers in response to a trip condition, said transmitting member and said receiving mechanism each including a primary connection and a secondary connection; and a plurality of linkages structured to interconnect at least the primary connections of a first interlock assembly of said interlock assemblies with the primary connections of a second interlock assembly of said interlock assemblies and the secondary connections of said first interlock assembly with the secondary connections of a third interlock assembly of said interlock assemblies, wherein said first and second interlock assemblies are structured to be coupled, respectively, to first and second corresponding circuit breakers, and said third interlock assembly is structured to be coupled to a third corresponding circuit breaker, and wherein said linkages are adapted to provide a predetermined automatic bypass interlock mechanism, without requiring a separate manual locking device.

2. The interlock system of claim 1 wherein said receiving mechanism comprises a receiving member and a paddle member coupled to said receiving member, said paddle member being structured to move with said receiving member in order to engage and actuate said trip lever in response to said trip condition.

3. The interlock system of claim 1 wherein said interlock system is a four-way interlock system; wherein said bypass transfer switch includes as said circuit breakers, said first, second and third corresponding circuit breakers and a fourth corresponding circuit breaker; and wherein said interlock assemblies include said first, second and third interlock assemblies which are structured to be coupled, respectively, to said first, second and third corresponding circuit breakers and, a fourth interlock assembly structured to be coupled to said fourth corresponding circuit breaker.

4. The interlock system of claim 3 wherein said linkages include first, second, third and fourth pairs of push, pull cables; wherein said first pair of push, pull cables interconnects said primary connections of said first interlock assembly of said first corresponding circuit breaker with said primary connections of said second interlock assembly of said second corresponding circuit breaker; wherein said second pair of push, pull cables interconnects said secondary connections of said first interlock assembly with said secondary connections of said third interlock assembly of said third corresponding circuit breaker; wherein said third pair of push, pull cables interconnects said primary connections of said third interlock assembly with said primary connections of said fourth interlock assembly of said fourth corresponding circuit breaker; and wherein said fourth pair of push, pull cables interconnects said secondary connections of said fourth interlock assembly with said secondary connections of said second interlock assembly.

5. The interlock system of claim 4 wherein each of said first, second, third and fourth corresponding circuit breakers has an ON state corresponding to said poleshaft being disposed in said first position and said separable contacts being closed, an OFF state corresponding to said poleshaft being disposed in said second position and said separable contacts being open, and includes a partner circuit breaker among the other circuit breakers of said first, second, third and fourth corresponding circuit breakers; and wherein when one of said first, second, third and fourth corresponding circuit breakers is ON, said partner circuit breaker thereof may be either ON or OFF and said predetermined automatic bypass interlock mechanism is structured to automatically hold the remaining circuit breakers of said first, second, third and fourth circuit breakers, OFF.

6. The interlock system of claim 4 wherein said first and said fourth corresponding circuit breakers are normal circuit breakers; wherein said second and said third corresponding circuit breakers are emergency circuit breakers; wherein said predetermined automatic bypass interlock mechanism performs a bypass of at least one of said normal circuit breakers with one of said emergency circuit breakers; and wherein said pairs of push, pull cables are structured to automatically provide said bypass.

7. The interlock system of claim 4 wherein each interlock assembly of said first, second, third and fourth interlock assemblies includes a cable bracket having four receptacles structured to receive and secure two pairs of said first, second, third and fourth pairs of push, pull cables; and wherein said cable bracket is further structured to couple said two pairs of push, pull cables to said corresponding circuit breaker proximate said mounting bracket of said interlock assembly.

8. The interlock system of claim 7 wherein said receiving mechanism includes a receiving member; wherein said transmitting member and said receiving member of each of said first, second, third and fourth interlock assemblies include a first end and a second end; wherein said primary connections are coupled to the first ends of said transmitting member and said receiving member and said secondary connections are coupled to the second ends of said transmitting member and said receiving member, respectively; and wherein said primary and secondary connections of said transmitting member are fixed connections each comprising one push, pull cable fixedly secured adjacent to said first and second ends of said transmitting member by a first plurality of fasteners, in order that said push, pull cable moves with said transmitting member and does not move independently with respect thereto.

9. The interlock system of claim 8 wherein said primary and secondary connections of said receiving member are push, pull connections each comprising one push, pull cable being movably coupled to said first and second ends of said receiving member by a slider and a second plurality of fasteners, said slider structured to provide movement of said push, pull cable independently with respect to said receiving member in one of a push direction and a pull direction, said second plurality of fasteners structured to engage said receiving member in order that said push, pull cable and said receiving member move together in the other of said push direction and said pull direction.

10. The interlock system of claim 8 wherein each of said interlock assemblies further includes first and second springs; wherein said first spring is disposed between the first end of said transmitting member and said mounting bracket in order to bias said transmitting member and said poleshaft to which it is coupled, toward said second position in which said separable contacts are open; and wherein said second spring is disposed between the first end of said receiving member and said mounting bracket in order to bias said receiving member away from actuating said trip lever.

11. A bypass transfer switch comprising:

a plurality of circuit breakers each having a pair of separable contacts and, an operating mechanism for opening and closing said separable contacts, said operating mechanism including a poleshaft operable between first and second positions corresponding to said separable contacts being closed and opened, respectively, and a trip lever adapted to open said separable contacts when actuated; and an interlock system adapted to provide a predetermined automatic bypass interlock mechanism for said circuit breakers, said interlock system comprising:

a plurality of interlock assemblies each coupled to a corresponding one of said circuit breakers and including a mounting bracket coupled on or proximate to said corresponding one of said circuit breakers, a transmitting member disposed on said mounting bracket and coupled to said poleshaft of said operating mechanism of said corresponding one of said circuit breakers in order to move therewith, and a receiving mechanism disposed on said mounting bracket and structured to engage and actuate said trip lever of said operating mechanism of said corresponding one of said circuit breakers in response to a trip condition, said transmitting member and said receiving mechanism each including a primary connection and a secondary connection, and a plurality of linkages structured to interconnect at least the primary connections of a first interlock assembly of said interlock assemblies with the primary connections of a second interlock assembly of said interlock assemblies and the secondary connections of said first interlock assembly with the secondary connections of a third interlock assembly of said interlock assemblies, wherein said first and second interlock assemblies are coupled, respectively, to first and second corresponding circuit breakers, and said third interlock assembly is coupled to a third corresponding circuit breaker, and wherein said linkages are adapted to provide said predetermined automatic bypass interlock mechanism, without requiring a separate manual locking device.

12. The bypass transfer switch of claim 11 wherein said receiving mechanism comprises a receiving member and a paddle member coupled to said receiving member, said paddle member being structured to move with said receiving member in order to engage and actuate said trip lever in response to said trip condition.

13. The bypass transfer switch of claim 11 including as said circuit breakers, said first, second and third corresponding circuit breakers and a fourth corresponding circuit breaker, wherein said interlock system is a four-way interlock system; and wherein said interlock assemblies include said first, second and third interlock assemblies which are coupled, respectively, to said first, second and third corresponding circuit breakers and, a fourth interlock assembly coupled to said fourth corresponding circuit breaker.

14. The bypass transfer switch of claim 13 wherein said linkages include first, second, third and fourth pairs of push, pull cables; wherein said first pair of push, pull cables interconnects said primary connections of said first interlock assembly of said first corresponding circuit breaker with said primary connections of said second interlock assembly of said second corresponding circuit breaker; wherein said second pair of push, pull cables interconnects said secondary connections of said first interlock assembly with said secondary connections of said third interlock assembly of said third corresponding circuit breaker; wherein said third pair of push, pull cables interconnects said primary connections of said third interlock assembly with said primary connections of said fourth interlock assembly of said fourth corresponding circuit breaker; and wherein said fourth pair of push, pull cables interconnects said secondary connections of said fourth interlock assembly with said secondary connections of said second interlock assembly.

15. The bypass transfer switch of claim 14 wherein each of said first, second, third and fourth corresponding circuit breakers has an ON state corresponding to said poleshaft being disposed in said first position and said separable contacts being closed; an OFF state corresponding to said poleshaft being disposed in said second position and said separable contacts being open; and, includes a partner circuit breaker among the other circuit breakers of said first, second, third and fourth corresponding circuit breakers; and wherein when one of said first, second, third and fourth corresponding circuit breakers is ON, said partner circuit breaker thereof may be either ON or OFF and said predetermined automatic bypass interlock mechanism automatically holds the remaining circuit breakers of said first, second, third and fourth circuit breakers, OFF.

16. The bypass transfer switch of claim 14 wherein said first and said fourth corresponding circuit breakers are normal circuit breakers; wherein said second and said third corresponding circuit breakers are emergency circuit breakers; wherein said predetermined automatic bypass interlock mechanism is structured to perform at least one of said normal circuit breakers with one of said emergency circuit breakers; and wherein said pairs of push, pull cables automatically provide said bypass.

17. The bypass transfer switch of claim 14 wherein each interlock assembly of said first, second, third and fourth interlock assemblies includes a cable bracket having four receptacles which receive and secure two pairs of said first, second, third and fourth pairs of push, pull cables; and wherein said cable bracket couples said two pairs of push, pull cables to said corresponding one of said circuit breakers proximate said mounting bracket of said interlock assembly.

18. The bypass transfer switch of claim 17 wherein said receiving mechanism includes a receiving member; wherein said transmitting member and said receiving member of each of said first, second, third and fourth interlock assemblies include a first end and a second end; wherein said primary connections are coupled to the first ends of said transmitting member and said receiving member and said secondary connections are coupled to the second ends of said transmitting member and said receiving member, respectively; and wherein said primary and secondary connections of said transmitting member are fixed connections each comprising one push, pull cable fixedly secured adjacent to said first and second ends of said transmitting member by a first plurality of fasteners, in order that said push, pull cable moves with said transmitting member and does not move independently with respect thereto.

19. The bypass transfer switch of claim 18 wherein said primary and secondary connections of said receiving member are push, pull connections each comprising one push, pull cable being movably coupled to said first and second ends of said receiving member by a slider and a second plurality of fasteners, said slider structured to provide movement of said push, pull cable independently with respect to said receiving member in one of a push direction and a pull direction, said second plurality of fasteners structured to engage said receiving member in order that said push, pull cable and said receiving member move together in the other of said push direction and said pull direction.

20. The bypass transfer switch of claim 18 wherein each of said interlock assemblies further includes first and second springs; wherein said first spring is disposed between the first end of said transmitting member and said mounting bracket in order to bias said transmitting member and said poleshaft to which it is coupled, toward said second position in which said separable contacts are open; and wherein said second spring is disposed between the first end of said receiving member and said mounting bracket in order to bias said receiving member and away from actuating said trip lever.

* * * * *